US009314674B2

(12) United States Patent
Canobbio

(10) Patent No.: US 9,314,674 B2
(45) Date of Patent: Apr. 19, 2016

(54) SPORT OBJECT HAVING MULTIPLE, RE-POSITIONABLE, MULTI-FACED EXTERIOR APPENDAGES FOR COLOR CHANGING AND DECORATIVE PURPOSES ACTUATED BY HAND MANIPULATION

(71) Applicant: Dan Canobbio, Frisco, TX (US)

(72) Inventor: Dan Canobbio, Frisco, TX (US)

( * ) Notice: Subject to any disclaimer, the term of this patent is extended or adjusted under 35 U.S.C. 154(b) by 0 days.

(21) Appl. No.: 14/664,118

(22) Filed: Mar. 20, 2015

(65) Prior Publication Data

US 2015/0265881 A1 Sep. 24, 2015

Related U.S. Application Data

(60) Provisional application No. 61/968,659, filed on Mar. 21, 2014.

(51) Int. Cl.

| | |
|---|---|
| ***A63B 43/00*** | (2006.01) |
| *A63B 37/06* | (2006.01) |
| *A63B 37/12* | (2006.01) |
| *A63B 37/14* | (2006.01) |

(52) U.S. Cl.

CPC ..... *A63B 43/002* (2013.01); *A63B 43/008* (2013.01); *A63B 37/06* (2013.01); *A63B 37/12* (2013.01); *A63B 37/14* (2013.01)

(58) Field of Classification Search

CPC ..... A63B 43/00; A63B 43/002; A63B 2043/001; A63B 2043/008; A63B 37/06; A63B 37/12; A63B 37/14

See application file for complete search history.

(56) References Cited

U.S. PATENT DOCUMENTS

| | | | | | |
|---|---|---|---|---|---|
| 248,362 | A * | 10/1881 | Spangler | F41J 9/16 | 273/365 |
| 3,220,142 | A * | 11/1965 | Butterfield | A63H 33/18 | 446/46 |
| 4,262,911 | A * | 4/1981 | Opresik | A63H 33/18 | 446/231 |
| 5,280,906 | A * | 1/1994 | Vitale | A63B 43/00 | 273/DIG. 20 |
| 5,458,329 | A * | 10/1995 | Bushman | A63B 43/002 | 273/DIG. 8 |
| 5,674,101 | A * | 10/1997 | Saloor | A63B 65/00 | 446/46 |
| 6,220,980 | B1 * | 4/2001 | Adler | A63B 43/002 | 473/612 |
| 6,354,970 | B1 * | 3/2002 | Reinke | A63B 37/00 | 473/600 |
| D650,536 | S * | 12/2011 | Oblack | D21/713 | |
| 2005/0043127 | A1 * | 2/2005 | Stephens | A63H 27/00 | 473/613 |
| 2010/0216579 | A1 * | 8/2010 | Williams | A63H 33/18 | 473/613 |
| 2011/0152018 | A1 * | 6/2011 | Walling | A63B 41/00 | 473/614 |

* cited by examiner

*Primary Examiner* — Steven Wong

(57) ABSTRACT

A sport object actuated by a user comprises: a ball, one or more grooves configured on the exterior of the ball, at least one elastomeric base rests within at least one of the groove at a first base position and one or more appendages molded at the edge of the elastomeric base to form a first appendage position. The shape of the ball is spherical. The shape of the sport object as well as the shape of the appendage can be sized and shaped in a variety of sizes to accomplish the same result of providing a changed color or decoration on the surface of the ball manually.

6 Claims, 4 Drawing Sheets

SPORT OBJECT HAVING MULTIPLE, RE-POSITIONABLE, MULTI-FACED EXTERIOR APPENDAGES FOR COLOR CHANGING AND DECORATIVE PURPOSES ACTUATED BY HAND MANIPULATION

CROSS REFERENCE TO RELATED PATENT APPLICATION

The present invention claims priority of the U.S. provisional patent application No. 61/968,659 filed on Mar. 21, 2014; all of which are incorporated herein by reference in their entireties.

BACKGROUND OF THE DISCLOSURE

1. Field of the Invention

The invention relates to a sport object having multiple, re-positionable, multi-faced exterior appendages for color changing and decorative purposes actuated by hand manipulation.

2. Description of Related Art

Various decorative balls are available in the market, such as colored balls. Generally, these balls all have predefined color. This kind of decorative ball are boring and dull in appearance. Nowadays children are attracted towards interactive games such as video games therefore they are losing interest on outdoor activities due to lack of interactive toys and balls.

However, colored balls mainly serve to provide only decorative effect and are rarely used in games in which the user can participate actively. Also, the balls are getting boring, and there exists a need to make the recreational balls which is interactive and usable in different fields.

There also exists liquid-filled or thickened-liquid-filled balls which change colors when squeezed. However such balls face various issues such as that when the skin of the ball is ruptured, the colored liquid flows into the surroundings and stains furniture, carpet and clothes. Therefore, there is a need of a sports object that is interactive with the users.

SUMMARY OF THE INVENTION

In accordance with the teachings of the present invention, a sport object actuated by a user is provided.

An object of the present invention is to provide a sport object actuated by a user. The sport object includes a ball, one or more grooves configured on the exterior of the ball, at least one elastomeric base rests within at least one of the groove at a first base position, and one or more appendages molded at the edge of the elastomeric base to form a first appendage position.

The user pushes the appendages from the first appendage position to a second appendage position resulting in the shift of the elastomeric base from the first base position to a second base position, further the elastomeric base settles on the inner edge of the groove and further maintains the second appendage position at the second base position.

Another object of the present invention is to provide the appendage includes a first side and a second side, wherein the second side is of different color from the first side.

Another object of the present invention is to provide the ball with at least one of a semi-permeable; and a non-permeable membrane.

These and other objects, features and advantages of the invention will become more fully apparent in the following detailed description, taken in conjunction with the accompanying drawings.

Figure 1:
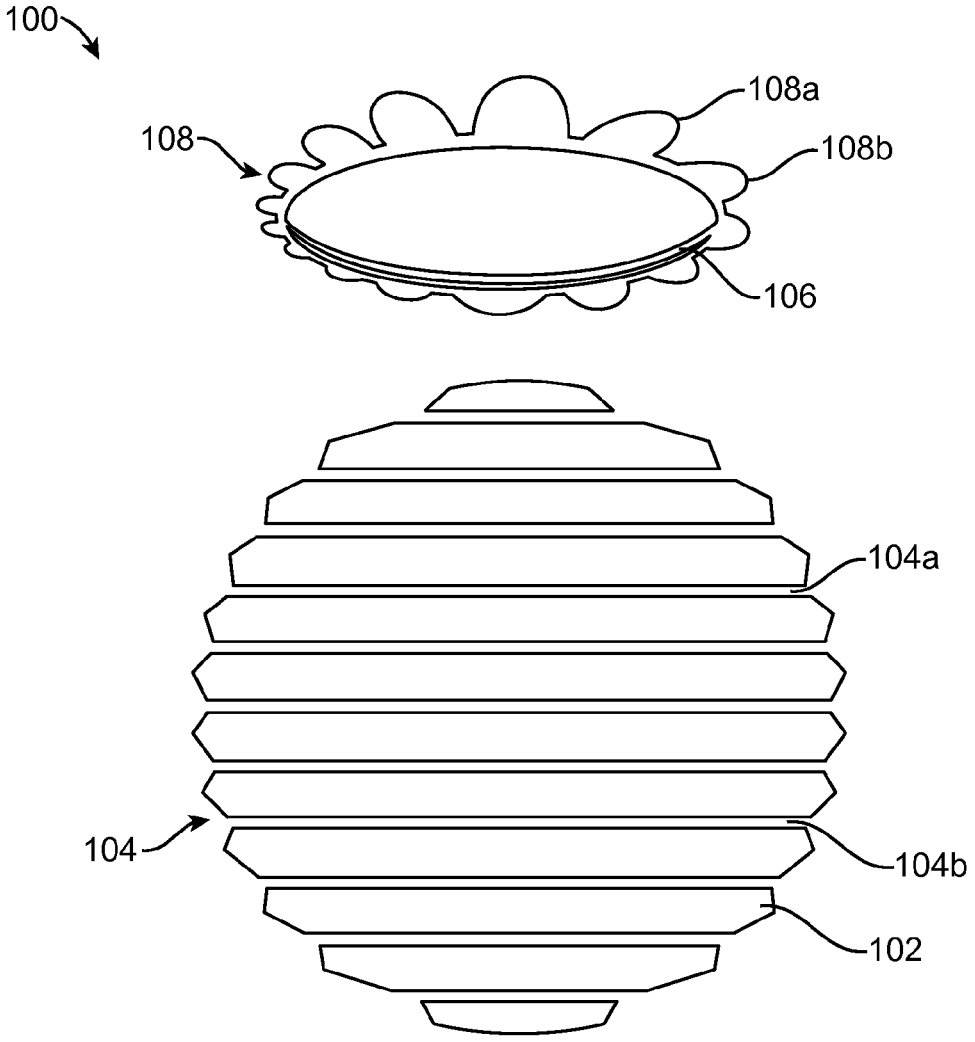
FIG. 1 illustrates an exploded view of a sport object according to the preferred embodiment of the present invention.

The foregoing summary, as well as the following detailed description of certain embodiments of the present invention, will be better understood when read in conjunction with the appended drawings. For the purpose of illustrating the invention, certain embodiments are shown in the drawings. It should be understood, however, that the present invention is not limited to the arrangements and instrumentality shown in the attached drawings.

DETAILED DESCRIPTION OF DRAWINGS

While this technology is illustrated and described in a preferred embodiment, the sport object may be produced in many different configurations, forms and materials. There is depicted in the drawings, and will herein be described in detail, as a preferred embodiment of the invention, with the understanding that the present disclosure is to be considered as an exemplification of the principles of the invention and the associated functional specifications for its construction and is not intended to limit the invention to the embodiment illustrated. Those skilled in the art will envision many other possible variations within the scope of the technology described herein.

FIG. 1 illustrates an exploded view of a sport object 100 actuated by a user. The sport object 100 includes a ball 102, one or more grooves 104 such as groove 104*a* and groove 104*b* configured on the exterior of the ball 102, at least one elastomeric base 106 formed as a ring as shown in FIG. 1 rests within the at least one of the groove 104 at a first base position, and one or more appendages 108 such as appendage 108*a* and 108*b* molded at the edge of the elastomeric base 106 to form a first appendage position.

The user pushes the appendage 108 from the first appendage position to a second appendage position and thus results in the shift of the elastomeric base 106 from the first base position to a second base position. The elastomeric base 106 settles on the inner edge of the groove 104 on receiving the push from the user. The properties of the elastomeric base 106 help in maintaining the second appendage position at the second appendage position.

Figure 2:
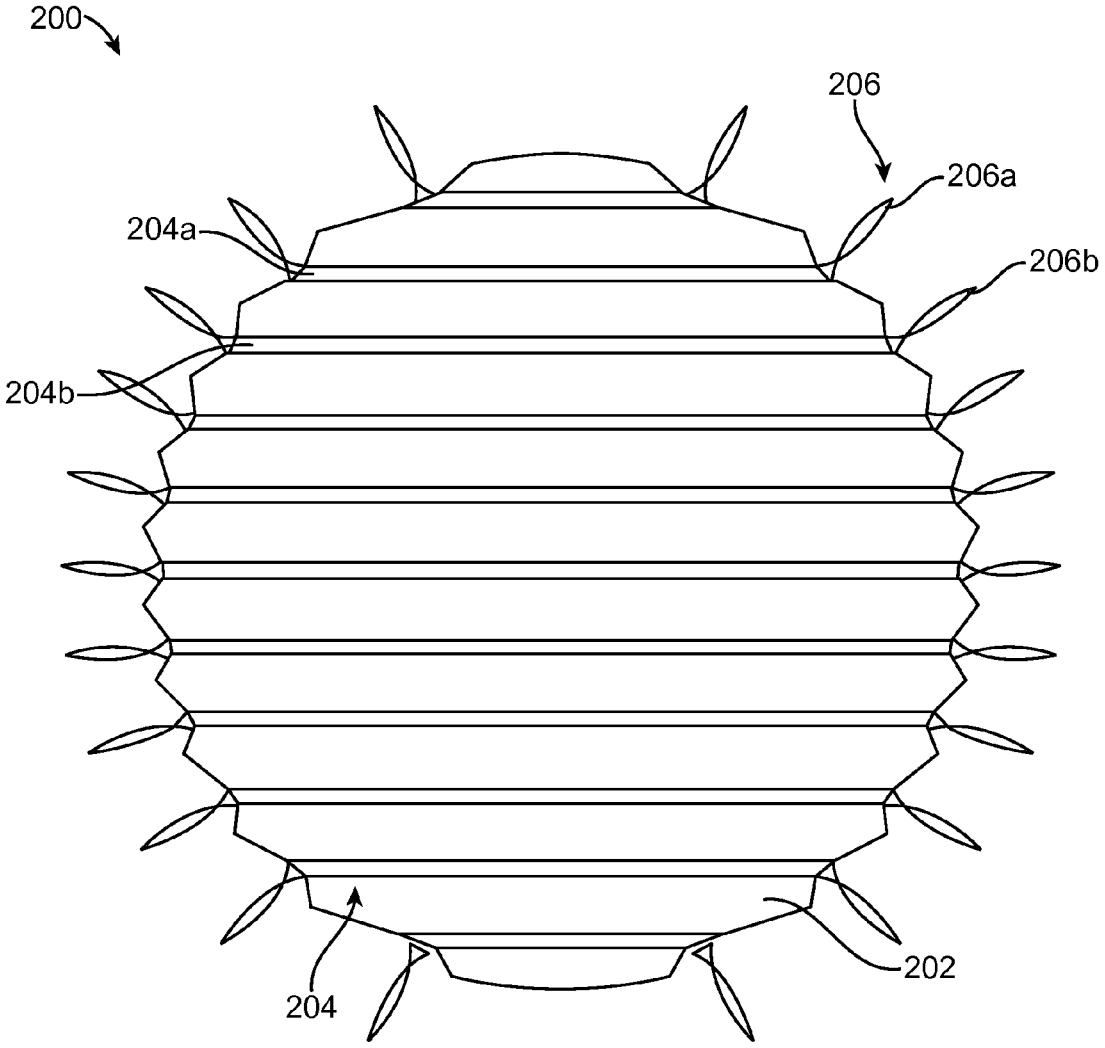
FIG. 2 illustrates a front view of a sport object showing the first base position of the appendages according to the preferred embodiment of the present invention.
Figure 3A:
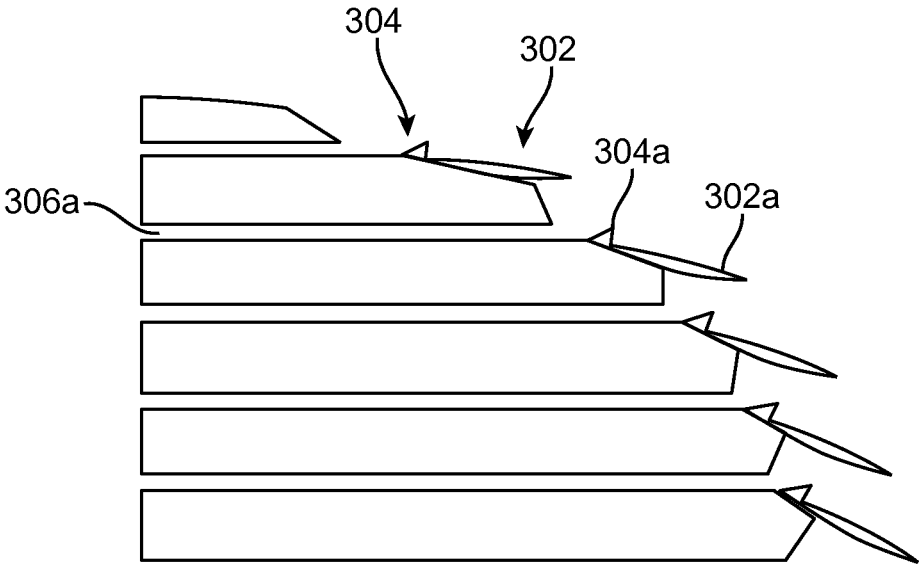
FIG. 3A illustrates a front view of a sport object showing second appendages position pushed by the user in the right side according to the preferred embodiment of the present invention.
Figure 3B:
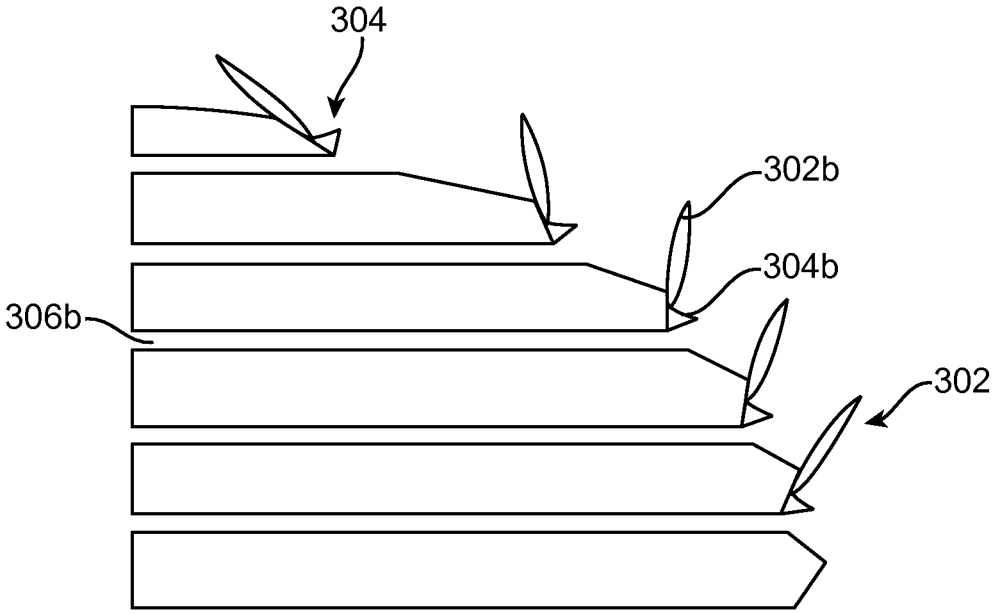
FIG. 3B illustrates a front view of a sport object showing second appendages position pushed by the user in the left side according to the another preferred embodiment of the present invention.

The position of the elastomeric base 106 with respect to the groove 104 is explained in detail in conjunction with FIG. 2 and FIG. 3A and FIG. 3B of the present invention. The first base position and the first appendage position are explained in detail in conjunction with FIG. 2 and FIG. 3A and FIG. 3B of the present invention. The second base position and the second appendage position are explained in detail in conjunction with FIG. 3A and FIG. 3B of the present invention.

FIG. 2 illustrates a front view of a sport object 200 showing the first base position and the first appendage position actuated by the user in a preferred embodiment of the present invention. The sport object 200 includes the ball 202, one or more grooves (not shown in FIG. 2), elastomeric base 204 such as 204*a* and 204*b*, one or more appendages 206 such as 206*a* and 206*b*.

In a preferred embodiment of the present invention, the first base position is defined when the elastomeric base 204 is within the groove (not shown in FIG. 2) and the first appendage position is the position of the appendages 206 perpendicular to the elastomeric base 204. In a preferred embodiment of the present invention, the one or more appendages 206 has two sides and further each side of the appendages 206 has a different color. Thus, if the ball 202 is looked from the top view, the first appendage position shows no color as the appendages 206 are in perpendicular position.

In a preferred embodiment of the present invention, the shape of the ball 202 is spherical. However, it would be readily apparent to those skilled in the art that various shapes of ball 202 may be envisioned such as roundish, square, or round, football-shaped, or disc-shaped without deviating from the scope of the present invention. The ball 202 may either consists of a semi-permeable or non-permeable membrane.

In another preferred embodiment of the present invention, examples of the material used for creating the ball 202, the elastomeric base 204, the appendages 206 may include but not limited to thermoplastic rubber, pvc, rubber, urethane.

In another preferred embodiment of the present invention, the shape of the appendages 206 may be flat, almond-shaped, having detail like of vinyl layers of flowers or animal characters, etc. However, it would be readily apparent to those skilled in the art that various shapes of appendages 206 may be envisioned without deviating from the scope of the present invention.

FIG. 3A illustrates a front view of the appendages 302 in the second appendage position with respect to the second base position of the elastomeric base 304 in a preferred embodiment of the present invention. In the second appendage position, the appendage 302*a* is pushed by the user in the right side and further the push enables the elastomeric base 304*a* to settle on the right side edge of the groove 306*a*. The elastomeric properties of the elastomeric base 304 maintain the position of the appendage 302*a* at the second appendage position.

FIG. 3B illustrates another front view of the appendages 302 in the second appendage position with respect to the second base position of the elastomeric base 304 in another preferred embodiment of the present invention. In the second appendage position, the appendage 302*b* is pushed by the user in the left side and further the push enables the elastomeric base 304*b* to settle on the left side edge of the groove 306*b*. The elastomeric properties of the elastomeric base 304 maintain the position of the appendage 302*b* at the second appendage position.

In a preferred embodiment of the present invention, the elastomeric base 304 is an elastic band having elastomeric properties. In a preferred embodiment of the present invention, the shape of elastomeric base 304 is triangular. However, it will be readily apparent to those skilled in the art that various shapes of the elastomeric base 404 such as square, spherical etc may be envisioned without deviating from the scope of the present invention.

Figure 4:
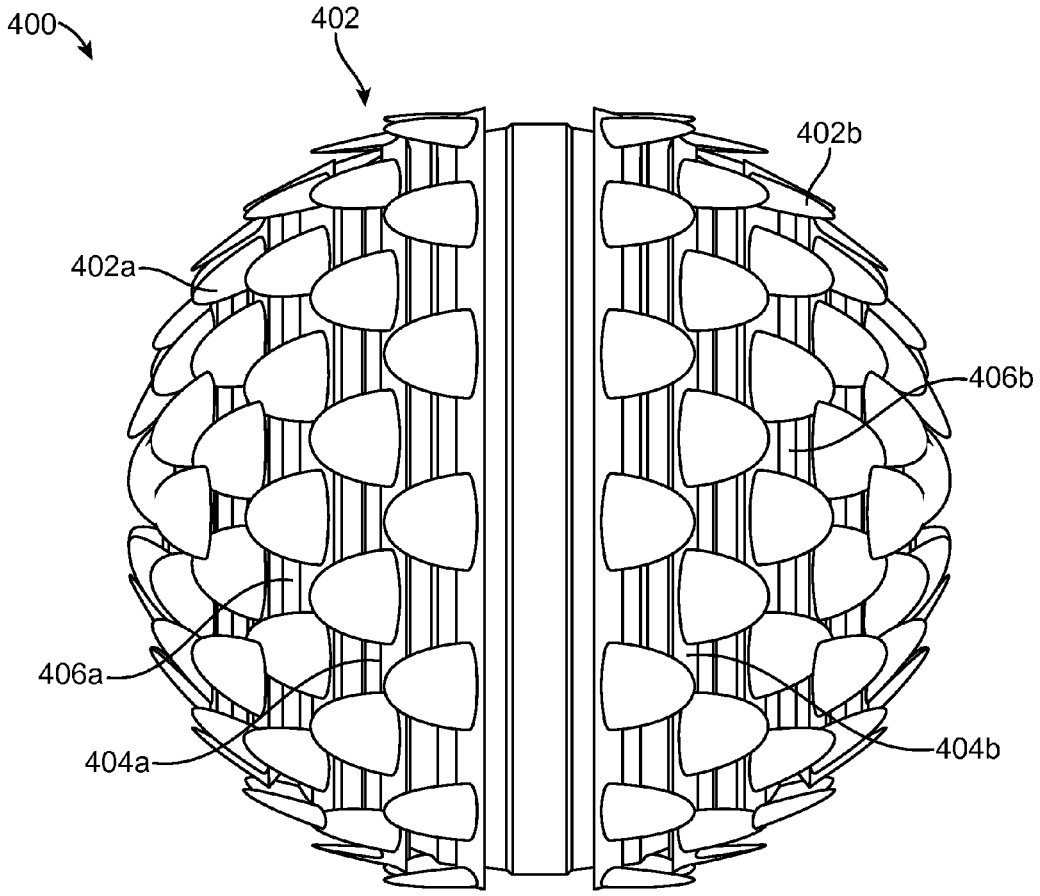
FIG. 4 illustrates a front view of a sport object showing different positions of the appendages according to the preferred embodiment of the present invention.

FIG. 4 illustrates another front view of a sport object 400 showing the different positions of the appendages 402 such as 402*a* appendage and 402*b* appendage. In the second appendage position, the appendage 402*a* is pushed by the user in the left side and further the push enables the elastomeric base 404*a* to settle on the left side edge of the groove 406*a*. In the second appendage position, the appendage 402*b* is pushed by the user in the right side and further the push enables the elastomeric base 404*b* to settle on the right side edge of the groove 406*b*.

There has thus been shown and described a sport object having multiple, re-positionable, multi-faced exterior appendages which fulfills all the items and advantages sought there for. Many changes, modifications, variations and other uses and applications of the subject invention will, however, become apparent to those skilled in the art after considering this specification and the accompanying drawings which disclose the preferred embodiments thereof. All such changes, modifications, variations and other uses and applications which do not depart from the spirit and scope of the invention are deemed to be covered by the invention, which is to be limited only by the claims which follow.

The invention claimed is:

1. A sport object actuated by a user comprising:

a ball;

plurality of grooves configured on the exterior of the ball having an outer edge and an inner edge;

plurality of elastomeric base ring, wherein at least one elastomeric base ring rotated around the ball on the inner edge of at least one of the groove at a first base position; and plurality of appendages, wherein each appendage molded at the edge of the elastomeric base rind to form a first appendage position with respect to the ball, wherein the elastomeric base ring rotated around the inner edge of the groove to form the first appendage position;

wherein the user pushes the appendages from the first appendage position to a second appendage position resulting in the shift of the elastomeric base ring from the first base position to a second base position, wherein the elastomeric base ring rests on the outer edge of the groove to form the second base position, further the elastomeric base ring settles within the outer edge of the groove and further maintains the second appendage position at the second base position.

2. The sport object according to claim 1 wherein the appendage comprising a first side and a second side, wherein the second side is of different color from the first side.

3. The sport object according to claim 1, wherein the ball comprising a non-permeable membrane.

4. The sport object according to claim 1, wherein the appendages comprising vinyl layers.

5. The sport object according to claim 1, wherein the ball comprising a semi-permeable membrane.

6. The sport object according to claim 1, wherein the appendages move from the first appendage position to the second appendage position in the range of 90 degrees to 180 degrees.

* * * * *